US008236090B2

(12) United States Patent
Schmidt et al.

(10) Patent No.: US 8,236,090 B2
(45) Date of Patent: Aug. 7, 2012

(54) PROCESS AND APPARATUS FOR PRODUCING METALS AND/OR PRIMARY METAL PRODUCTS

(75) Inventors: Martin Schmidt, Leonding (AT); Johannes Schenk, Linz (AT); Franz Hauzenberger, Linz (AT); Josef Stockinger, Luftenberg (AT); Johann Wurm, Bad Zell (AT)

(73) Assignee: Siemens Vai Metals Technologies GmbH (AT)

( * ) Notice: Subject to any disclaimer, the term of this patent is extended or adjusted under 35 U.S.C. 154(b) by 675 days.

(21) Appl. No.: 11/722,789

(22) PCT Filed: Dec. 6, 2005

(86) PCT No.: PCT/EP2005/013042
§ 371 (c)(1),
(2), (4) Date: Oct. 4, 2007

(87) PCT Pub. No.: WO2006/072308
PCT Pub. Date: Jul. 13, 2006

(65) Prior Publication Data

US 2008/0047397 A1 Feb. 28, 2008

(30) Foreign Application Priority Data

Dec. 23, 2004 (AT) ..... A 2168/2004

(51) Int. Cl.
*C21B 15/00* (2006.01)
*C22B 1/10* (2006.01)

(52) U.S. Cl. ..... 75/445; 266/172

(58) Field of Classification Search ..... None
See application file for complete search history.

(56) References Cited

U.S. PATENT DOCUMENTS

| | | | | |
|---|---|---|---|---|
| 4,049,247 | A | 9/1977 | Stamer et al. | |
| 5,584,910 | A | 12/1996 | Kepplinger et al. | 75/445 |
| 6,210,627 | B1 | 4/2001 | Gennari et al. | 266/44 |
| 6,214,083 | B1 | 4/2001 | Wiesinger | |
| 6,645,269 | B2 | 11/2003 | Zirngast | |
| 7,425,230 | B2 | 9/2008 | Nagl | 75/414 |

(Continued)

FOREIGN PATENT DOCUMENTS

CA 2 260 202 1/1998

(Continued)

OTHER PUBLICATIONS

Office Action dated Nov. 22, 2011 issued in corresponding Japanese Patent Application No. 2007-547236 with English translation (9 pages).

(Continued)

*Primary Examiner* — Emily Le
*Assistant Examiner* — Sarah A Slifka
(74) *Attorney, Agent, or Firm* — Ostrolenk Faber LLP

(57) ABSTRACT

The invention relates to a process and an associated apparatus for producing metals and/or primary metal products, in particular pig iron and/or primary pig iron products, in which a metal-containing charge material, in particular in fine particle form, is introduced, using pneumatic conveying, by means of a carrier gas stream, in the form of a stream of medium formed from the charge material and the carrier gas stream, into a melting unit, in particular a melter gasifier, for further processing. According to the invention, the charge material is introduced after the carrier gas stream has been separated off and separately at at least two introduction points, so that at least two partial quantities of the charge material can be introduced independently of one another and continuously or in stacked form.

19 Claims, 8 Drawing Sheets

U.S. PATENT DOCUMENTS

| | | | |
|---|---|---|---|
| 2003/0041690 | A1 | 3/2003 | Zirngast |
| 2005/0126341 | A1 | 6/2005 | Nagl |

FOREIGN PATENT DOCUMENTS

| | | |
|---|---|---|
| CA | 2251553 | 8/1998 |
| CA | 2 472 721 | 8/2003 |
| DE | 1 188 098 | 10/1963 |
| DE | 25 37 370 | 11/1976 |
| JP | 55-84850 | 6/1980 |
| JP | 59-80704 | 5/1984 |
| JP | 62-227022 | 10/1987 |
| JP | 4-361921 | 12/1992 |
| JP | 2001-501677 | 2/2001 |
| JP | 2001-152225 | 6/2001 |
| JP | 2005-517805 | 6/2005 |
| WO | WO 98/35064 | 8/1998 |
| WO | WO 01/83830 | 11/2001 |
| WO | WO 03/068994 | 8/2003 |

OTHER PUBLICATIONS

Office Action dated Jan. 10, 2012 issued in corresponding Canadian Patent Application No. 2,591,792 (10 pages).

PROCESS AND APPARATUS FOR PRODUCING METALS AND/OR PRIMARY METAL PRODUCTS

CROSS REFERENCE TO RELATED APPLICATION

The present application is a 35 U.S.C. §§371 national phase conversion of PCT/EP2005/013042, filed 6 Dec. 2005, which claims priority of Austrian Patent Application No. A 2168/2004, filed 23 Dec. 2004 the disclosure of which are herein incorporated by reference. The PCT International Application was published in the German language.

BACKGROUND OF THE INVENTION

The invention relates to a process for producing metals and/or primary metal products, in particular pig iron and/or primary pig iron products, in which an at least partially reduced, metal-containing charge material, in particular in fine particle form, is introduced, using pneumatic conveying, by means of a carrier gas stream, in the form of a stream of medium formed from the charge material and the carrier gas stream, into a melting unit, in particular a melter gasifier, for further processing.

The invention also relates to an apparatus for producing metals and/or primary metal products, in particular pig iron or primary pig iron products, from a metal-containing charge material, in particular in fine particle form, having a melting unit for the further processing of the charge material, in particular a melter gasifier, having a device for the pneumatic carrying of the charge material by means of a carrier gas stream.

It is known from the prior art that considerable demands are imposed in particular when carrying hot process materials. In addition to the thermal stresses on the carrier devices, in particular the quantitatively accurate carrying constitutes an important requirement which has to be met by the carrier system in order, through accurate process management, to achieve products having the desired profile of properties and little scatter with the properties.

In particular the carrying of metal-containing materials in fine particle form imposes high demands on the metallurgy process and installation technology. For example, in particular carrying warm or hot materials imposes additional demands on plant engineering.

It is known from the prior art to use what are known as pneumatic conveying devices for this purpose, with the material which is to be carried being moved by means of a gas stream.

WO 03/68994 A1 has disclosed a pneumatic conveying system of this type, which reveals the conveying of metal-containing charge materials by means of process gas withdrawn from the melting unit. In this case, however, in particular there is no solution as to how the metal-containing charge material should be introduced into the melting unit and how to achieve quantitative control of the introduction.

Working on the basis of the prior art, it is an object of the invention to provide a process in accordance with the preamble of claim 1 and an apparatus in accordance with the preamble of claim 11, which allow more accurate metering and distribution of charge materials and therefore more precise process management during the production of metal or primary metal products.

SUMMARY OF THE INVENTION

According to the invention, the object is achieved, with regard to the process, by the defining clause of claim 1 and, with regard to the apparatus, by the defining clause of claim 11.

According to the invention, the charge material is introduced into the melting unit separately and independently at at least two introductory points, with individual introduction now being possible at each introduction point. This introduction may take place continuously or in stacked form, i.e. in quantitatively limited batches.

This achieves a significant advantage, namely that the introduction of the partial quantities of the charge material into the melting unit can be locally and quantitatively controlled, so that targeted distribution of the charge materials in the melter gasifier becomes possible by means of the feeding arrangement. This offers advantages in particular when supplying charge materials in fine particle form. The measures described allow significantly better process management in the melting unit, since an optimum distribution between charge material and further process materials, such as for example carbon carriers, is made possible by influencing the distribution of the charge materials. It has proven advantageous that dividing the stream of medium into two to eight partial streams of medium ensures advantageous introduction.

The configuration with a multiplicity of independent addition points ensures targeted feeding of the melting unit, so that a controlled distribution of the charge material in the melting unit is possible. It has been possible to determine from tests that an advantageous distribution of the charge material and, for example, a carbon carrier is possible with just six introduction points.

According to an advantageous embodiment of the process according to the invention, before the carrier gas stream is separated off, the stream of medium is divided into at least two independent partial streams of medium, which can then be processed further separately from one another or can be introduced into the melting unit independently of one another, with the partial carrier gas being separated off from each partial stream of medium before the charge material is introduced. Division into partial streams of medium allows even better influencing of the introduction of charge material and therefore of the process management. In particular the possibility of introduction in stacked form at each point independently of one another allows systematic process optimization by exploiting the variability of the system.

Alternatively, it is also possible for the charge material to be split into partial quantities after the carrier gas stream has been separated off from the stream of medium. This particular configuration makes it possible, for example, to add additional charge materials before the charge material is introduced, allowing joint introduction.

According to a further advantageous embodiment of the process according to the invention, the carrier gas used to convey the charge material is a process-internal gas, in particular process gas from the melting unit. The use of process-internal gas first of all creates a low-cost solution. Furthermore, it is possible for the process gas used as carrier gas to be circulated, which also provides benefits only a small quantity of carrier gas is required, on account of the pneumatic carrying of the at least partially reduced, metal-containing charge material. Alternatively, by way of example, it is also possible to use the process gas from a treatment reactor for carrying.

According to an alternative embodiment of the process according to the invention, the carrier gas used to convey the charge material is a process-external gas, in particular nitrogen. This alternative allows correspondingly effective pneumatic conveying to be ensured even if the quantities of process gas available are insufficient. Furthermore, there are often sufficient quantities of pressurized nitrogen available in steelworks, so that as a result it is once again possible to take account of existing resources.

According to a further, alternative embodiment of the process according to the invention, a further carrier gas in addition to a process-internal gas is used to carry the charge material. This constitutes an advantageous solution, for example, for situations in which additional carrier gas is used from time to time, for example to temporarily increase the conveying capacity. This measure also makes it possible to carry relatively large quantities of charge material in stacked form for short times, for example to an intermediate vessel or also for conveying into the melting unit.

It has proven advantageous for the charge material to be introduced continuously or in stacked form into the carrier gas stream in a controlled manner. These two specific options allow the respective process conditions to be adapted by making the charge material available accordingly. In this context, it is possible to maintain the carrier gas stream and in each case to introduce the required quantity of charge material into the carrier gas stream, either continuously or in stacked form, i.e. in a limited quantity. In any event, the introduction takes place in a controlled manner, so that accurate feeding of the melting unit is ensured. In addition to quantitatively accurate feeding of charge material, this also encompasses an accurate local distribution of the charge material(s) in the melting unit.

It has likewise proven advantageous for the pneumatic conveying itself to be carried out continuously or in stacked form, i.e. suitably adapted to the prevailing process state. This means that the carrier gas stream, depending on demand, can be maintained continuously or switched on as appropriate. This flexible operating mode allows the pneumatic conveying to be constantly adapted to the prevailing process conditions, so that for example in special process situations operating costs can be saved by adapting the operating mode.

According to one possible configuration of the process according to the invention, the carrier gas stream which has been separated off can be introduced into a treatment reactor after gas purification. On account of the quantities of gas which are required to convey the charge material, it is sensible for economic and process engineering reasons to further utilize or exploit the carrier gas. This allows the quantity of carrier gas which is to be discharged to be virtually completely reused, after suitable purification, in the treatment reactor.

According to an advantageous configuration of the process according to the invention, the controlled introduction of the partial quantities of the charge material is effected by means of a targeted removal of the partial carrier gas streams which have been separated off. Controlled removal of the partial carrier gas after it has been separated off creates an effective and simple way of controlling the partial quantity of charge material which is carried. This allows independent control of the partial conveyed quantities by means of the partial carrier gas quantities which are removed.

According to an advantageous embodiment of the process according to the invention, the charge material or its partial quantities is/are temporarily stored in a storage vessel before being introduced into the melting unit. This temporary storage on the one hand allows stacked introduction into the melting unit and on the other hand, by virtue of the storage, allows the introduction to be isolated from the preceding conveying of the charge material, resulting in more stable process management, which is also less susceptible to faults or deviations in individual process parameters.

According to a particular embodiment of the process according to the invention, the charge material or the partial quantities thereof is/are subjected to the action of pressure. This involves targeted adjustment of the pressure for further processing. As a result, particularly simple introduction of the charge material, for example purely under the force of gravity, into the melting unit is possible. Furthermore, it is possible to realize simple introduction devices, which means that complex valves or control units, for example, are no longer required.

As a result of the increase in pressure prior to the introduction of the charge material into the melting unit, it is possible to decouple the pneumatic conveying or any temporary storage of the charge material from the introduction into the melting unit. In this case, the storage vessel functions as a lock between the process parts which operate at different pressure levels. The pressure at which the pneumatic conveying takes place can therefore be set optimally, independently of the operating pressure of the melting unit, without it having to be matched to the pressure of the melting unit. This results in processes and installation parts which are simpler to control and are less expensive.

According to an alternative embodiment of the process according to the invention, at least one reduced, iron-containing addition and/or additive is/are introduced into the melting unit in addition to the charge material. This option allows the process to be influenced or corrected even more successfully. The introduction of at least one addition and/or additive can in this case take place together with the charge material or separately; it is also possible to use the same introduction points or introduction devices. For example, it is possible to alternately introduce additions, additives or charge material using the same introduction devices. Introduction of the additions and/or additives into the abovementioned intermediate vessel and joint introduction of the mixture of substances is also possible, so that accurate introduction even in a locally clearly defined manner is possible, which offers a very flexible solution in terms of process engineering.

The apparatus according to the invention in accordance with the defining clause of claim 11 offers a simpler structure which is suitable for carrying out said process. By dividing the controlled introduction of the charge material into the melting unit into at least two introduction points and using the introduction devices, it is possible to provide a robust installation which allows full flexibility with regard to the independent introduction at different introduction points. By combining these measures with the separation device, it is additionally possible to improve the melting process in particular when using charge materials in fine particle form, and to reduce the problems of considerable discharge of fine material from the melting unit together with process gas. Since moving parts are virtually completely eliminated from the apparatus, the installation created is very robust and simple to maintain. In its simplest embodiment, the introduction device is designed as a line which, in combination with a valve, allows control.

Since the charge material may be at temperatures of 800° C., the parts of the installation which come into contact with the charge material may also be exposed to high thermal stresses. This also gives rise to the demand for a robust apparatus using simple plant engineering, which is achieved by the dividing apparatus described.

According to a particular configuration of the apparatus according to the invention, the dividing device is suitable for splitting the stream of medium formed from charge material and carrier gas stream into at least two partial streams of medium. The partial streams of medium in each case comprise a partial quantity of the charge material and a partial carrier gas stream, so that they can be treated further on an individual basis. Streams of medium can be divided even in the case of hot charge materials in fine particle form, and this can be realized by simple and robust devices. Dividing even into a large number of partial streams is possible and therefore offers an implementation which is simple in terms of plant engineering even for complex systems. The partial streams of medium also have the advantage that they can be introduced into the melting unit in different ways, and the use of separation devices means that only the partial quantities of the charge material are introduced.

The use of a dividing device without moving parts also offers an operationally reliable solution.

According to a further advantageous configuration of the apparatus according to the invention, the dividing device can be connected, via a line, to the device for pneumatically carrying the charge material and/or, via at least two, in particular six, lines, to the melting unit. On account of the division into partial quantities of charge material or into partial streams of medium, the charge material can be passed to the introduction points of the melting unit. In this case, it is possible to make do with fixed connections, i.e. there is no need for moving or flexible components, and consequently there are also no parts of the installation which require intensive maintenance. The dividing device may in this case be configured in such a way that it passes a stream of medium made up of carrier gas and charge material or alternatively just the charge material to the introduction points of the melting unit. The individual and independent supply to the introduction point is crucial. The number of feed lines to the melting unit may depend on the particular introduction requirements, since it is in this way possible to produce a desired distribution of the charge material in the melting unit. It has been found that it is advantageous to provide at least six feed lines into the melting unit, since in this case it is already possible to set an advantageous distribution of the charge materials in the melting unit.

According to an advantageous configuration of the apparatus according to the invention, the device for pneumatically carrying (3) is directed substantially upward, as seen in the conveying direction. This allows deposits or caking to be avoided.

According to one possible configuration of the apparatus according to the invention, the device for pneumatically carrying the charge material can be connected to the treatment reactor via at least one line. The connecting line allows at least partially reduced, metal-containing charge material to be conveyed, with a major advantage, namely the utilization of the energy content of the charge material for the melting process and therefore a process which is more efficient overall, being achieved by the option of conveying warm charge material. Combining a melting unit with a treatment reactor produces advantages which are known per se, namely the use of a hot, for example pre-reduced metal-containing charge material, since an energy-effective process can be used for processing. The properties of the process unit can be utilized successfully and advantageously in particular when processing metal carriers in fine particle form. In particular connecting the treatment reactor to a melting unit by means of a device, for pneumatic conveying of the metal carriers which have been converted in the treatment reactor into the melting unit, leads to a highly advantageous installation for carrying out the production process.

On account of the link to the treatment reactor, it is possible to utilize the process gas from the treatment reactor to convey the charge material. On account of the pressure situation in the treatment reactor, it is possible to make use of conveying of the charge material by the process gas of the treatment reactor at the operating pressure of the latter, offering an inexpensive solution which is simple in terms of the installation.

The charge material can be introduced into the device directly or by means of separate equipment, so that an appropriate plant design is possible depending on the process and requirements.

According to a particular configuration of the apparatus according to the invention, a separation device, in particular a cyclone, is provided for at least one of the partial streams of medium, for the purpose of separating the partial quantity of the charge material from the partial carrier gas stream. Dividing the stream of medium into partial streams of medium allows these partial streams to be treated further independently of one another. Installing a separation device for at least one of the partial streams of medium makes it possible to provide partial quantities of the charge material which are then available for introduction into a melting unit on demand. In this context, it is conceivable for individual partial streams of medium to be introduced directly into the melting unit, whereas for some of the partial streams of medium the carrier gas is separated off before introduction. This measure makes it possible, for example, to combine introduction in stacked form with continuous introduction, so that continuous conveying is produced at some introduction points and stacked introduction is produced at others. The use of a cyclone makes it possible to create an advantageously simple installation which is based on a proven concept.

According to an advantageous configuration of the apparatus according to the invention, the at least one separation device can be connected, by means of lines, to the melting unit, in order for the charge material to be introduced, if appropriate to a gas treatment device, in particular a wet purification device, for purifying the carrier gas stream, and to the dividing device. Treating the partial gas stream which has been separated off in a gas treatment device allows the carrier gas to be treated in such a manner that it can be reused in the overall process or in individual process steps. The treatment may, for example, be a wet treatment, such as for example a scrub, which removes dust and other fine particles. Consequently, the cyclone can be connected to the gas treatment device via a gas discharge line, while the charge material which has been separated off can be fed to the melting unit via a line. The partial stream of medium is fed to the separation device via a line, which means that all the connecting lines substantially make do without moving parts, producing a simple and reliable installation.

According to an alternative configuration of the apparatus according to the invention, a control valve for controlling the partial stream of medium is provided in the line between the separation device and the gas treatment device. The control valve in the line for removing the carrier gas from the separation device provides a very effective way, which is simple in terms of plant engineering, of controlling the stream of medium and therefore the partial quantity of charge material which is carried. This allows independent control of the partial conveying quantities by corresponding intervention by way of the carrier gas quantity removed from the separation device to the gas treatment device, without any valves or control elements themselves having to be brought into contact with the stream of medium, which means that the problems of wear with control elements of this type also do not arise.

According to one specific configuration of the apparatus according to the invention, the gas treatment device can be connected via a line to a process gas outlet line from the melting unit, in order to purify process gas from the melting unit. This connection allows an advantageous combined gas treatment and therefore produces a compact installation. By returning the treatment residues, for example into the melting unit, it is possible to avoid residual waste materials and therefore costs.

According to a further configuration of the apparatus according to the invention, an introduction device comprises a storage vessel, which can be subjected to the application of pressure, for introducing the charge material which has been separated off and/or the partial quantities thereof into the melting unit and/or at least one valve for the controlled introduction of the charge material. On account of the individual conveying of the partial quantities of charge material, it is possible for the partial quantity to be made available independently at each introduction point, in order to allow stacked and continuous introduction into the melting unit.

This specific embodiment of the invention makes it possible to decouple the introduction of the charge material into the melting unit from the conveying of the charge material, so that in addition to further functional options, greater process reliability is also achieved. On account of the possibility of increasing the pressure, it is possible for all the apparatus parts which are used to carry the charge material or interact with it to be operated individually at different pressure levels. By adapting the pressure immediately before introduction of the charge material, it is possible, for example, for the pneumatic conveying device and the separating device to be operated at a pressure which is optimum for these units, so that they do not have to be adapted with regard to the operating pressure. On account of temporary storage in a storage vessel, in addition to the quantity it is also possible for the time-based introduction into the melting unit to be accurately adapted at each introduction point, the interaction with a valve producing a simple and inexpensive installation.

According to one possible configuration of the apparatus according to the invention, the valve is designed as a slide valve or a pneumatic valve, in particular a self-block L valve. Valves of this type have proven advantageous since above all the particular temperature and abrasion stresses are important when controlling streams of material in metallurgical plants. Accordingly, it is necessary to provide devices which are able to cope with these demands. Slide valves have proven advantageous for control, since, on account of having a simple structure, they offer high operational reliability. L valves have also proven advantageous on account of their simple structure. Valves of this type comprise a double L-shaped conveying tube. If the carrier gas stream is switched off, the charge material remains in the middle section of the tube, resulting in a self-blocking action. If the length of the middle section of the tube and the charge material which remains therein are dimensioned appropriately, it is possible to achieve an effective blocking action. The simple structure produces a very high valve process reliability. A high ability to withstand thermal stresses is a further consequence of this design.

An advantageous configuration of the apparatus according to the invention provides a buffer vessel, to which pressure can be applied, for receiving the stream of medium, which buffer vessel can be connected to the device for pneumatic carrying and can also be connected, at at least two introduction points, if appropriate via at least two lines, to the melting unit. The buffer vessel according to the invention creates additional process reliability. On account of its volume, it is possible for the carrying of the charge material to be completely decoupled from the introduction into the melting unit. In this case, the buffer volume is selected to be sufficiently high for adequate feeding of the melting unit to be possible even in the event of carrying faults. Alternatively, the buffer function can also be utilized in such a manner that charge material is only conveyed to the buffer vessel from time to time and on demand. Connecting the buffer vessel to the melting unit by lines at at least two introduction points produces a stable and simple apparatus. An embodiment with at least six connections between the buffer vessel and the melting unit has proven advantageous, so that locally variable feeding of the melting unit is possible.

According to an advantageous configuration of the apparatus according to the invention, an introduction device comprises a storage vessel which can be connected via a line to the buffer vessel, it being possible for carrier gas from the buffer vessel to be applied to the storage vessel.

In addition to the buffer function, the buffer vessel can also perform the function of the separation device, so that the stream of medium which is delivered by the pneumatic conveying device can be introduced into the buffer vessel, then the carrier gas stream can be separated off and the charge material can be split and introduced into the melting unit through at least two feed lines. The introduction of each of the at least two partial quantities of the charge material can take place via a storage vessel, in each case arranged between the buffer vessel and the melting unit, and associated valves, so that an additional storage function and separation of the pressure adjustment from the buffer vessel are possible.

The specific embodiment creates a pressure compensation line between the buffer vessel and the at least two storage vessels, so that it is possible to feed the storage vessels by changing from pressure compensation between the units and pressure increase in the storage vessel to pressure matching to the melting unit.

According to a particular embodiment of the apparatus according to the invention, at least one feed device, comprising a feed vessel and/or a lock, is provided for introducing metal-containing additions and/or additives into the melting unit, preferably via the buffer vessel and/or the introduction device. In addition to the charge material, it is often necessary to feed further process auxiliaries to the melting unit. Dedicated devices are provided for this purpose, allowing a controlled supply of additions and/or additives. The supply can in this case be effected by separate introduction into the melting unit or together with the charge material. It is preferable for the additions and/or additives to be introduced into the melting unit together with the charge material, in which case these substances are added to the charge material for example in the buffer vessel or in the introduction device.

According to one possible configuration of the apparatus according to the invention, a diverter device for distributing or positioning the charge material in the melting unit is provided at at least one introduction point, at which the charge material and if appropriate additions and/or additives are introduced into the melting unit. This special device allows targeted and even more successful introduction of the charge material into the melting unit, since the diverter device creates an additional way of positioning the charge material in the melting unit. Diverter devices used may, for example, include pivotable chutes, which allow the charge material to be distributed from the respective introduction point.

According to an additional configuration of the apparatus according to the invention, the dividing device provided is a dynamic distributor for distributing or positioning the charge material and any additions and/or additives in the melting unit. The distributor can be connected, via a feed line, to the separation device, if appropriate to the storage vessel or to the buffer vessel and, via at least two lines, to the melting unit. The dynamic distributor, by virtue of an active diverter element, allows individual supply to individual introduction points into the melting unit or to the buffer vessel or alternatively to a storage device. The dynamic distributor is based on a moving diverter device, such as for example a chute, and a plurality of discharge lines and constitutes a further way of dividing the charge material and supplying it independently via separate introduction points.

According to one possible configuration of the apparatus according to the invention, at least one addition device which can be subjected to the application of pressure, in particular an addition vessel, and at least one valve for the continuous or stacked introduction of the charge material into the carrier gas stream are provided between the treatment reactor and the device for pneumatic conveying. In addition to direct and continuous addition of the charge material into the device for pneumatic conveying, it has proven advantageous for this to be effected by a dedicated device which can be subjected to the application of pressure. It is in this way possible to compensate for different pressure levels, for example between the treatment reactor and the device for pneumatic carrying. One specific configuration provides at least one addition vessel and a valve for controlled addition of the charge material into the pneumatic carrying device. These devices also allow sudden addition of the charge material, so that even compact quantities of charge material can be carried. Furthermore, this allows very accurate addition by stacked introduction.

According to an advantageous configuration of the apparatus according to the invention, a conveyor apparatus, in particular a conveyor screw, and/or an ejector is/are provided instead of the valve. The discharge from the addition vessel into the pneumatic carrying device is effected by means of a conveyor screw, producing a reliable and inexpensive apparatus. The conveyor screw is suitable in particular for the continuous addition of the charge material. The use of an ejector, similar to the principle of a water jet pump, causes the charge material to be introduced into the carrier gas stream and moved by the sucking action of the carrier gas stream. This obviates the need for temperamental actuating and switching devices for the addition of the charge material. This also offers an advantageous solution with regard to wear.

According to a further configuration of the apparatus according to the invention, at least one addition device and an upstream vessel for increasing pressure are provided, allowing lock-like feeding with charge material and an increase in pressure. This arrangement allows the feed device and the vessel to be operated together similarly to locks. After the upper vessel has been filled, it is disconnected from the treatment reactor by a valve and the charge material is introduced into the addition vessel. After the two vessels have been disconnected by means of a valve, after suitable pressure adjustment, it is possible to effect the addition to the pneumatic carrying device.

According to one configuration of the apparatus according to the invention, at least two addition devices connected in parallel are provided for alternate filling and emptying of the addition devices. This configuration is advantageous in particular for continuous feeding, since a continuous addition of the charge material can be implemented by alternate filling and emptying of the addition vessels.

According to an alternative configuration of the apparatus according to the invention, the device for pneumatic carrying has at least one feed line for a further carrier gas. It is advantageous to provide additional carrier gas in particular in processes where the process gas is not available in sufficient quantity or quality. In this case, the additional carrier gas can be taken from an external gas source or a supply network and fed to the pneumatic carrying device. This is realized by a feed line to the pneumatic carrying device.

The invention is explained in more detail with reference to the following figures and on the basis of possible advantageous embodiments. In the drawing:

DESCRIPTION OF THE PREFERRED EMBODIMENTS

Figure 1:
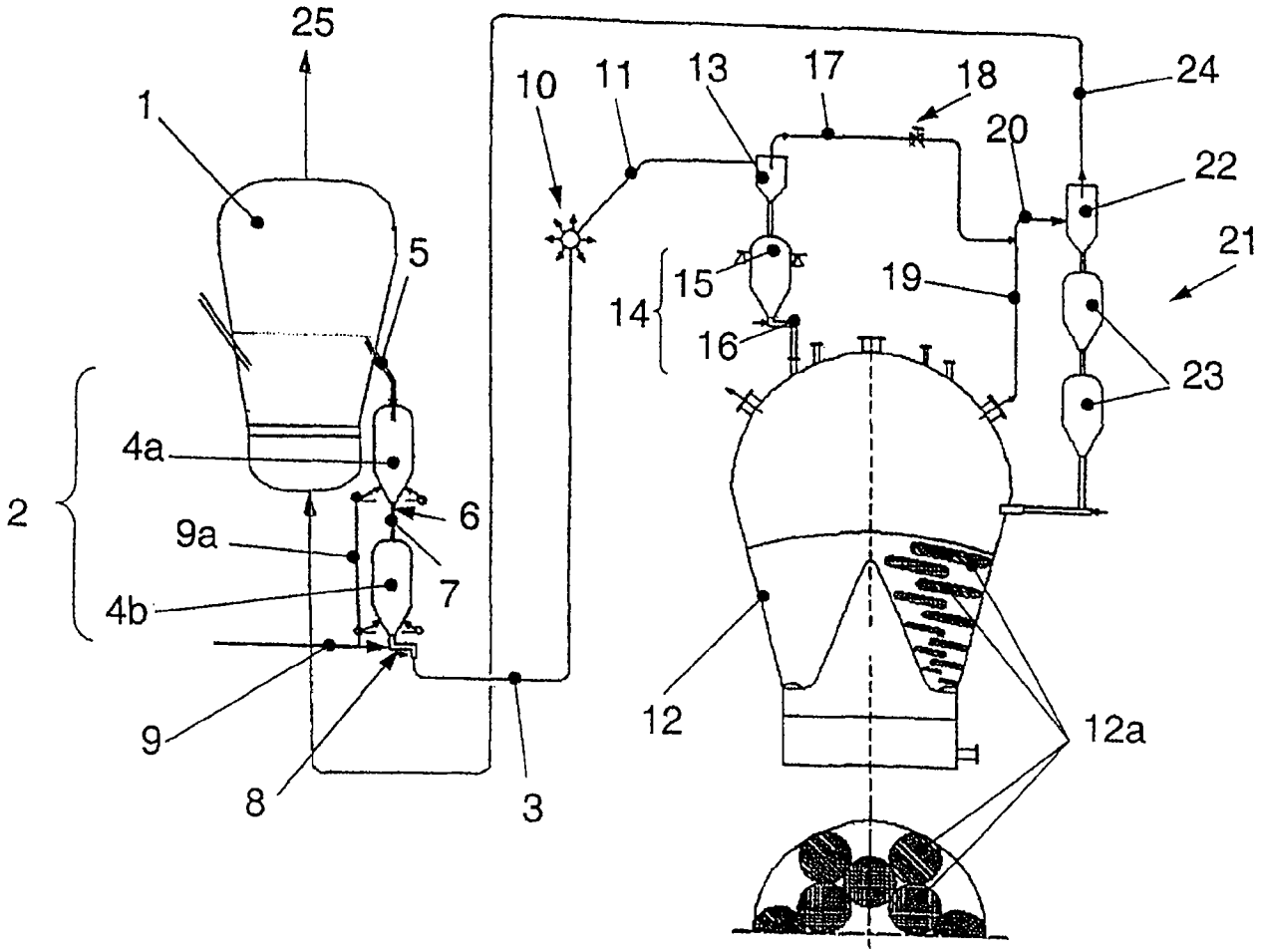
FIG. 1 shows the apparatus according to the invention with addition device, dividing device and storage vessel, separation device and gas treatment device.

FIG. 1 illustrates a possible configuration of the invention. The charge material is at least partially reduced in the treatment reactor 1 and fed via the addition device 2 to the pneumatic carrying device 3. The addition device 2 comprises two addition vessels 4*a* and 4*b*, which are connected to the treatment reactor and to one another via lines 5 and 6. A valve 7 is provided for separating the two addition vessels 4*a*, 4*b*. A valve 8, which is designed as a self-blocking L valve, is provided for disconnection from the pneumatic carrying device 3. A feed line 9 for the carrier gas is provided at the valve 8. The two addition vessels 4*a* and 4*b* can be subjected to the application of pressure from the carrier gas via lines 9*a*. The pneumatic carrying device 3 is connected to a separating device 10 which allows the stream of medium to be divided into partial streams of medium. The number of lines 11 can be selected according to the process requirements, with even six lines 11 allowing advantageous feeding of the melting unit 12. The dividing device is connected via the lines 11 to in each case a separation device 13 which separates the carrier gas from the charge material. Via a line, the charge material is introduced into the melting unit 12 through an introduction device 14, in each case comprising a storage vessel 15 and a valve 16. The introduction at a plurality of introduction points allows an advantageous distribution of the charge material 12*a* in the melting unit 12 to be achieved. 12*a* denotes a position with compact charge material, while the regions in between are filled with other materials, such as for example a carbon carrier or mixtures of materials. The valve 16 may advantageously be designed as a self-blocking L valve. The separation device 13 is connected, via a line 17 which includes a valve 18, to a line 19 for discharging process gas from the melting unit 12. Via a line 20, the carrier gas and the process gas from the melting unit 12 are together fed to a gas treatment device 21. Solids are separated out in the cyclone 22 and fed to the melting unit via storage vessel 23. The purified gas can be passed via a line 24 into the treatment reactor 1. The treatment reactor 1 has a line 25 for discharging process gas.

Figure 2:
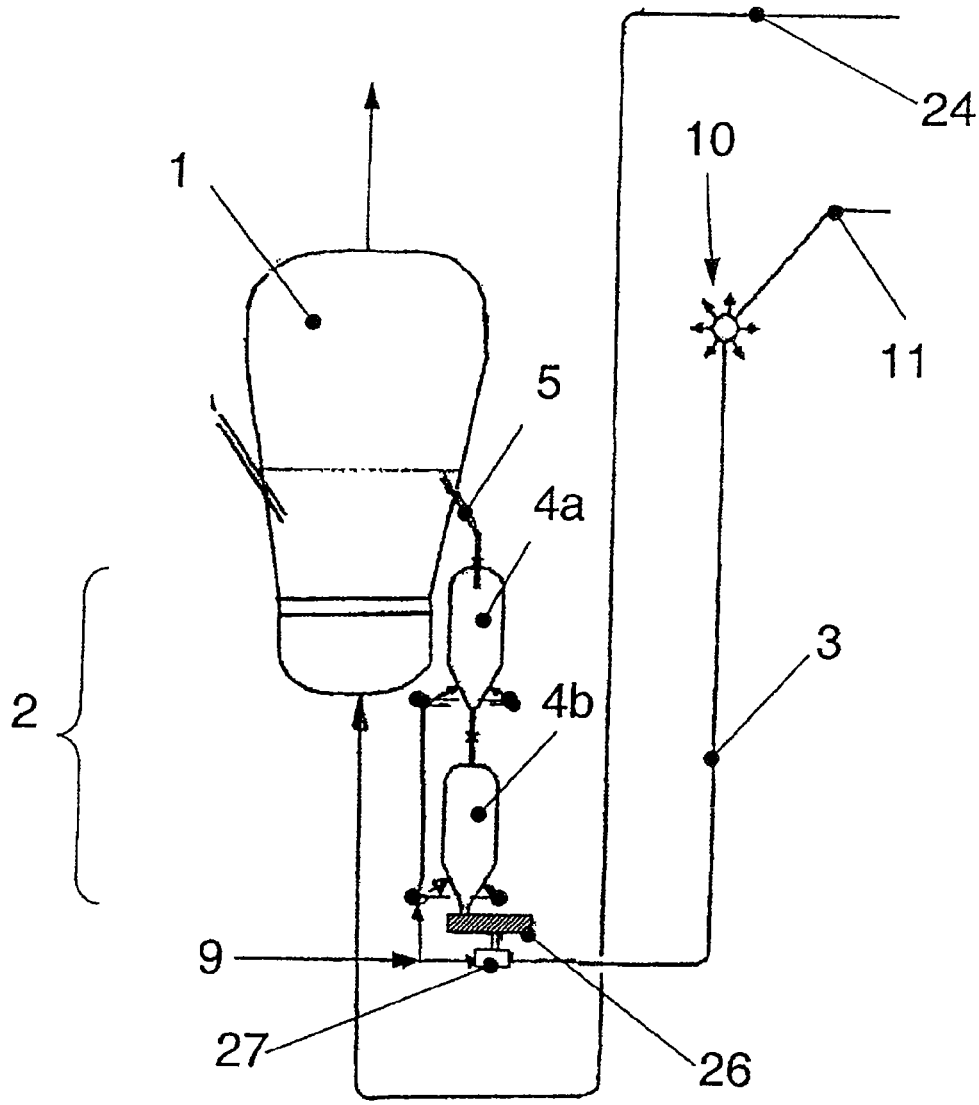
FIG. 2 shows the addition device with ejector.

FIG. 2 shows a variant on the addition device 2, in which a screw conveyor 26 is provided instead of the valve. This conveyor is used for the controlled discharge of the charge material, with the charge material being introduced into the carrier gas stream by means of an ejector 27.

Figure 3:
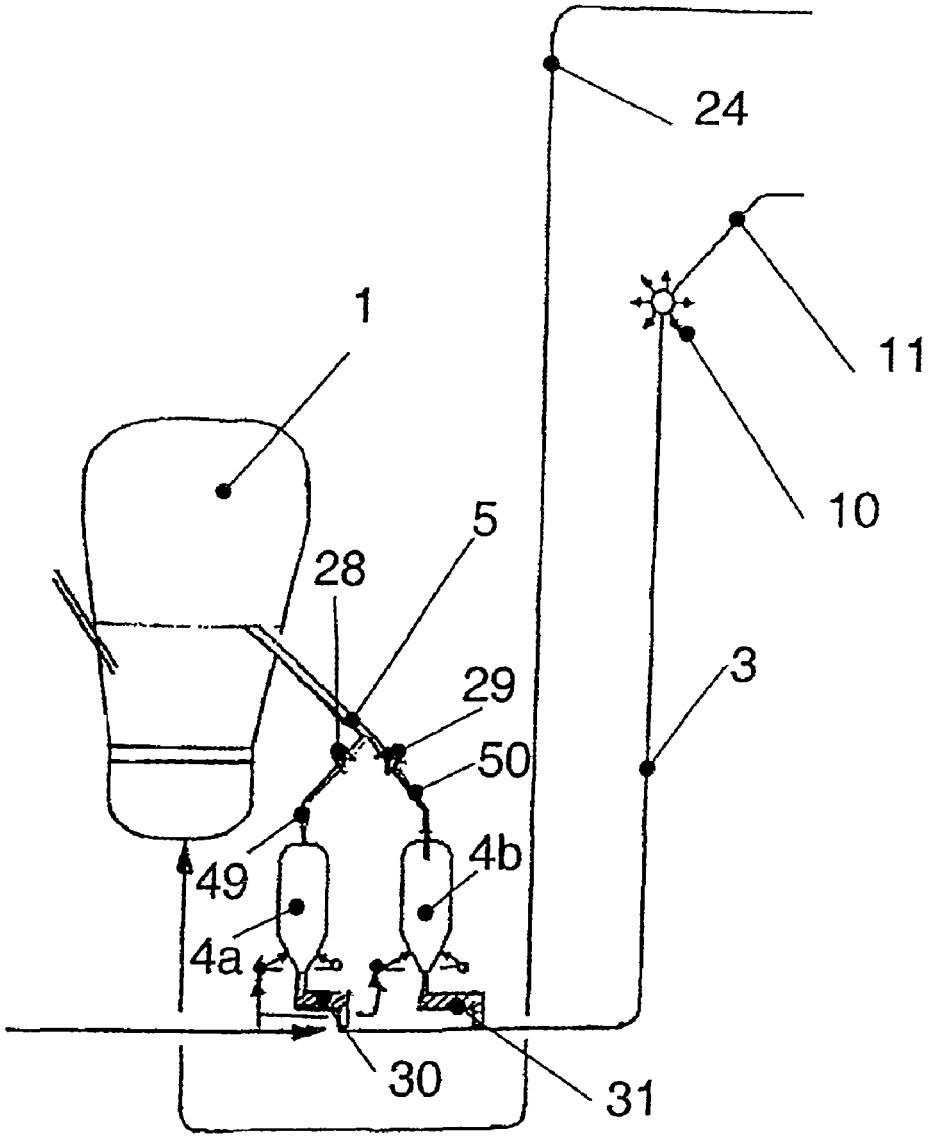
FIG. 3 shows the addition device with parallel addition devices.

FIG. 3 shows an advantageous configuration of the addition device 2, in which there are two addition vessels 4*a* and 4*b* arranged in parallel with one another. The two addition vessels 4*a* and 4*b* can be alternately fed with charge material via a feed line, which can be split into two connection lines 26 and 27 with the associated valves 28 and 29. This allows continuous addition of the feed material to the pneumatic conveying device 3. Addition to the carrier gas stream can be effected, for example, by way of screw conveyors 30 and 31.

Figure 4:
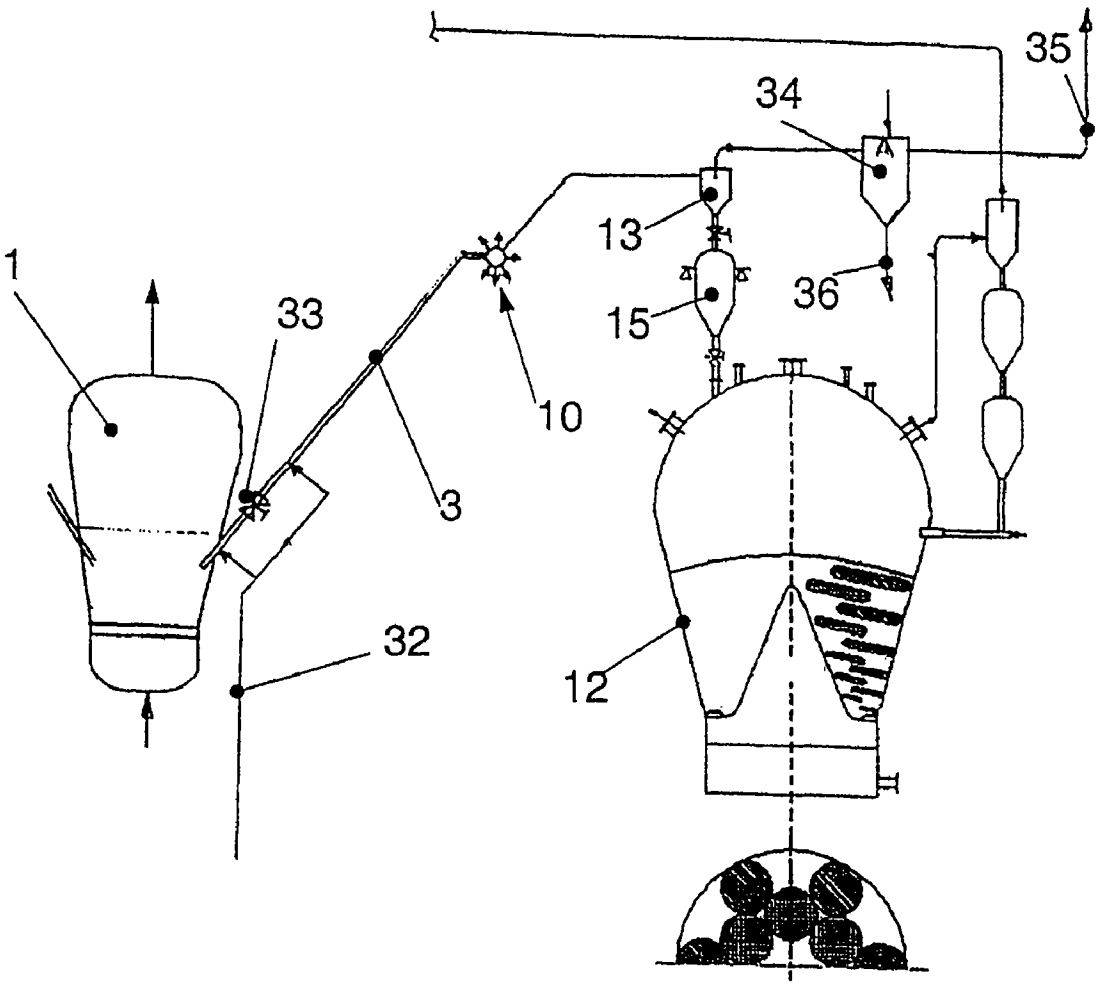
FIG. 4 shows direct carrying by means of process gas.

FIG. 4 illustrates direct conveying of the charge material from the treatment reactor 1 to a separating device 10. Additional carrier gas can be introduced into the pneumatic conveying device 3 via a feed line 32. The pneumatic conveying device can be separated from the treatment reactor 1 by means of a valve 33, so that the conveying can be controlled in this way. The carrier gas which has been withdrawn at the separation device 13 is fed to a wet scrubbing device 34, and the purified gas and solids or slurries are discharged from the process via lines 35 and 36, respectively.

Figure 5:
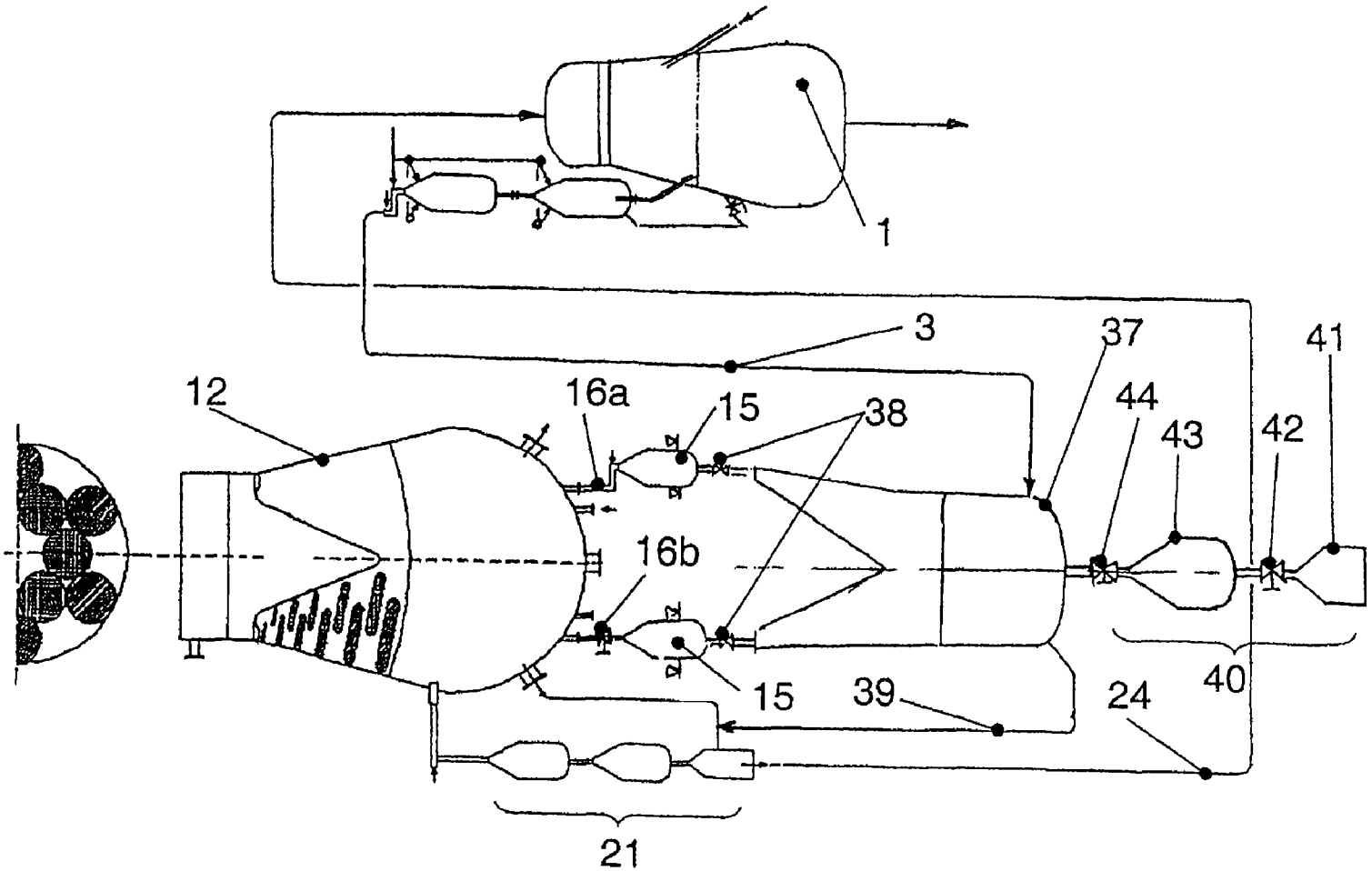
FIG. 5 shows a configuration with a buffer vessel.

FIG. 5 shows a particular configuration of the invention, in which a buffer vessel 37 is provided. In addition to its function as a buffer, this buffer vessel also acts as a dividing device, so that the stream of medium is fed via the pneumatic conveying device 3 without prior division of the carrier gas stream. This division then takes place after introduction into the buffer vessel 37, the lower part of which is formed in such a manner that the charge material is separated into partial quantities. The charge material is introduced via in each case a storage vessel 15 and in each case two valves 16 and 38, of which the valve 16 facing the melting unit may be designed as a self-blocking L valve 16*a* or as a slide valve 16*b*. The carrier gas and process gas are fed to a gas treatment device via the carrier gas discharge line 39 and the line 19 for discharging process gas from the melting unit 12. The purified gas mixture can be fed to the treatment reactor 1 via a line 24. A feed device 40, comprising a feed vessel 41, a lock 43 and associated valves 42 and 44, is provided for the use of additions or additives. The additions or additives can therefore be admixed with the charge material before the latter is introduced; embodiments with separate introduction into the melting unit are also possible.

Figure 6:
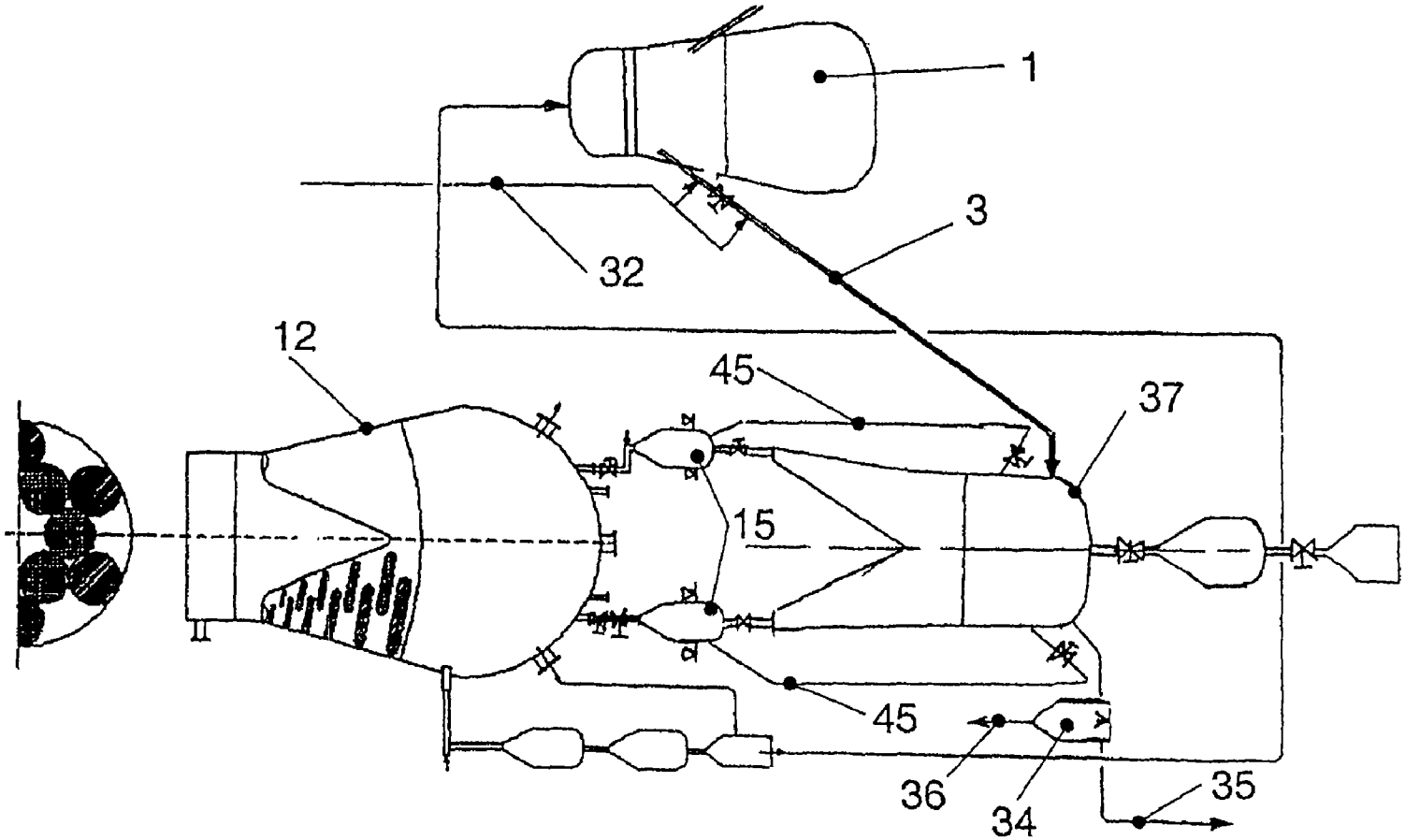
FIG. 6 shows an alternative configuration to the embodiment shown in FIG. 5.

FIG. 6 shows a variant on FIG. 5, in which the buffer vessel is pneumatically conveyed into the buffer vessel 37 using a by process gas from the treatment reactor 1 and optionally additional carrier gas. Since the buffer vessel is operated at a lower pressure than the melting unit, it is necessary for the charge materials to be subjected to the application of pressure before they are introduced into the melting unit 12. This takes place in the storage vessels 15, although the pressure-increasing apparatus is not illustrated in more detail here. The storage vessels, after they have been loaded, can be acted on with carrier gas via the lines 45 and then have the pressure relieved again, so that they can be refilled with charge material. The carrier gas which is extracted from the buffer vessel is treated in a wet scrubbing device 34, and the purified gas and solids or slurries are discharged from the process via lines 35 and 36, respectively.

Figure 7:
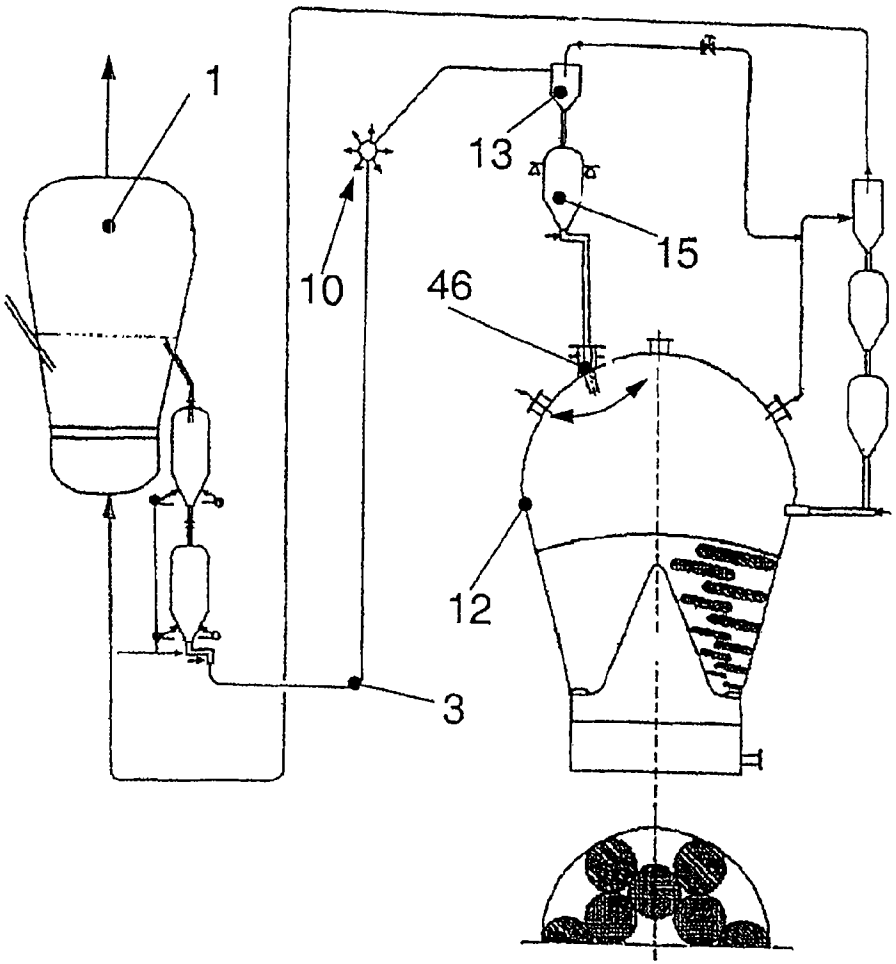
FIG. 7 shows an embodiment with a diverter device.

FIG. 7 illustrates a special diverter device 46 for introducing the charge materials into the melting unit 12. This diverter device allows additional positioning of the charge materials in the melting unit 12.

Figure 8:
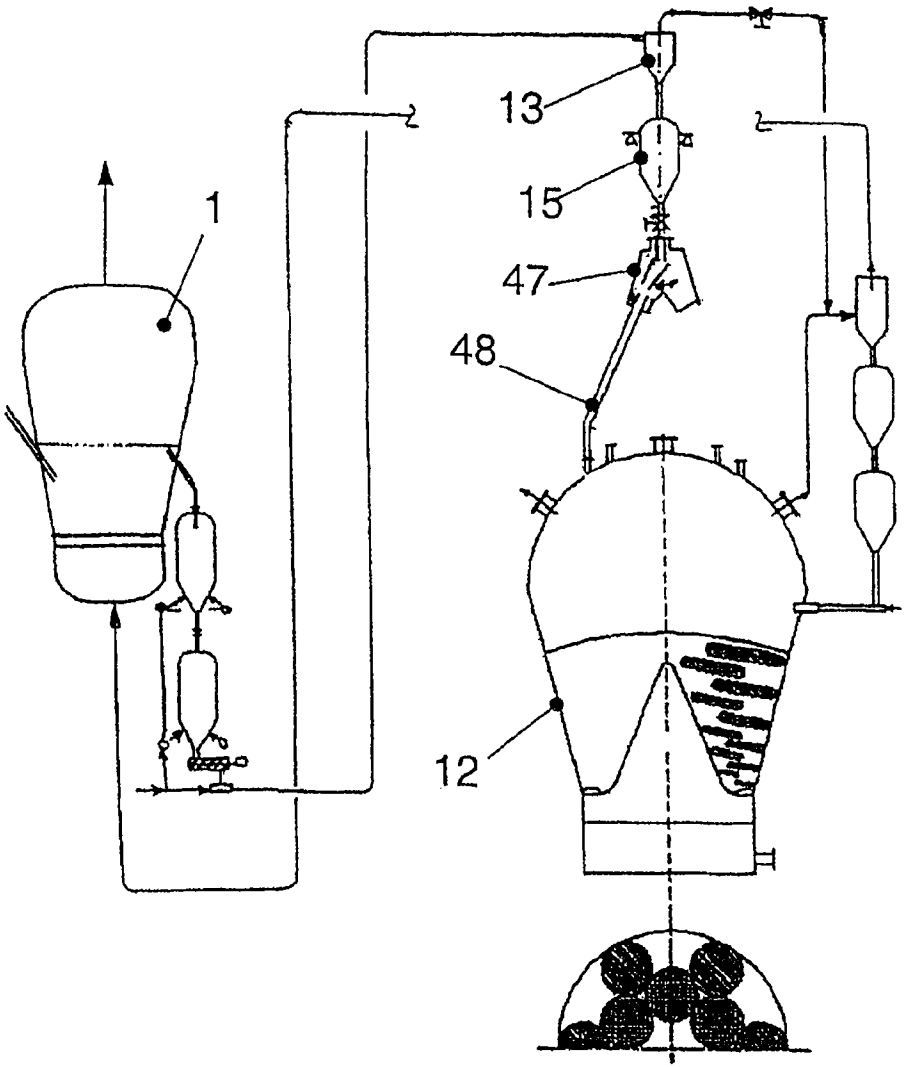
FIG. 8 shows an embodiment with a dynamic separating device.

According to FIG. 8, there is a central dynamic distributor 47, which is connected to the introduction points via lines 48 and is supplied with charge material via a storage device 15.

The invention claimed is:

1. A method for producing a metal or a primary metal product, the method comprising:

pneumatic conveying a stream including a carrier gas and a charge material comprising fine metal-containing particles;

dividing the stream into at least two partial streams, each stream comprising a respective quantity of charge material;

separating off the carrier gas from each of the at least two partial streams; and introducing at a first introduction point of a melting unit the charge material from a first stream of the at least two partial streams and introducing, independently of the introducing of the charge material of the first stream, the charge material from a second stream of the at least two partial streams at a second introduction point of the melting unit;

effecting control at the dividing of the stream of the quantity of charge material carried by each of the at least two partial streams by controlling the separating off of the carrier gas for each of the at least two partial streams prior to the introducing of the charge material.

2. The method as claimed in claim 1, wherein the carrier gas comprises a process-internal gas.

3. The method as claimed in claim 2, wherein the carrier gas further comprises a process-external gas.

4. The method as claimed in claim 2, wherein the process-internal gas comprises gas from the melting unit.

5. The method as claimed in claim 1, wherein the carrier gas comprises a process-external gas.

6. The method as claimed in claim 5, wherein the process-external gas comprises nitrogen.

7. The method as claimed in claim 1, wherein the carrier gas comprises a process-internal gas and a second carrier gas.

8. The method as claimed in claim 1, wherein at least a portion of the carrier gas that has been separated off is then introduced into a treatment reactor.

9. The method as claimed in claim 8, wherein the carrier gas that has been separated off is purified before introduction into the treatment reactor.

10. The method as claimed in claim 9, wherein additional purified gas from the melting unit is further introduced into the treatment reactor.

11. The method as claimed in claim 1, wherein at least a portion of the charge material is temporarily stored in a storage vessel before being introduced into the melting unit.

12. The method as claimed in claim 11, wherein the charge material is subjected to an action of pressure before being introduced into the melting unit.

13. The method as claimed in claim 1, wherein at least one metal-containing addition and/or at least one additive are introduced into the melting unit in addition to the charge material.

14. The method as claimed in claim 1, wherein the at least two partial streams comprise six partial streams.

15. The method as claimed in claim 1, wherein the at least two partial streams comprise between two and eight partial streams.

16. The method as claimed in claim 1, wherein the introducing of the charge material is performed continuously in time.

17. The method as claimed in claim 1, wherein the introducing of the charge material is performed in batches with gaps in time between the batches.

18. The method as claimed in claim 1, wherein the separating off of the carrier gas is performed for each of the at least two partial streams prior to the introduction of any of the charge material into the melting unit.

19. The method as claimed in claim 1, wherein the separating off of the carrier gas comprises a removal controlled in location with respect to the melting unit so as to control the quantity of charge material introduced at the first introduction point and the second introduction point.

* * * * *